US005139184A

United States Patent [19]

Seitz

[11] Patent Number: 5,139,184

[45] Date of Patent: Aug. 18, 1992

[54] GARMENT HANGER SHOULDER GUARD

[75] Inventor: Joel N. Seitz, Parsippany, N.J.

[73] Assignee: Product Development Partners, South Hackensack, N.J.

[21] Appl. No.: 785,447

[22] Filed: Oct. 31, 1991

[51] Int. Cl.[5] ..... A47G 25/14

[52] U.S. Cl. ..... 223/98

[58] Field of Search ..... 223/87, 98; 150/154; 312/3

[56] References Cited

U.S. PATENT DOCUMENTS

| | | | |
|---|---|---|---|
| 2,434,461 | 1/1948 | Forcheimer | 223/98 |
| 2,873,054 | 2/1959 | Zintel | 223/98 |
| 3,033,340 | 5/1962 | Zintel | 223/98 |
| 3,117,706 | 1/1964 | Kestner | 223/98 |
| 3,202,330 | 8/1965 | Hawkins | 223/98 |
| 4,988,022 | 1/1991 | Seitz | 223/98 |

*Primary Examiner*—Werner H. Schroeder
*Assistant Examiner*—Bibhu Mohanty
*Attorney, Agent, or Firm*—Samuelson & Jacob

[57] ABSTRACT

A shoulder guard for placement on a garment hanger so as to lie between the garment hanger and a garment to be hung on the garment hanger includes a sheet manufactured, assembled and folded at the manufacturing site into a flat, collapsed condition and readily unfolded in the field into an erected condition for placement on the garment hanger, without the necessity for any additional assembly operation, to provide an appropriate and improved contour for the support of the garment on the garment hanger, the sheet including first and second legs folded into a generally deep V-shaped configuration, where the legs make an acute angle to one another in a flattened collapsed condition, and unfolded into an erected condition where the legs form a relatively shallow V-shaped configuration in which the legs make an obtuse angle to one another, are aligned longitudinally in the same plane for placement over the garment hanger, and are contoured to provide the appropriate support for the garment.

14 Claims, 2 Drawing Sheets

GARMENT HANGER SHOULDER GUARD

The present invention relates generally to shoulder guards used in connection with garment hangers and pertains, more specifically, to a garment hanger shoulder guard which is transported and stored in a fully-assembled collapsed condition and is erected readily in the field for use on a garment hanger without further assembly operations.

Garment hangers constructed of wire have become the most widely accepted garment hangers for use in connection with handling garments in dry cleaning establishments. Shoulder guards constructed of card stock are utilized in connection with such hangers almost universally to protect garments against wrinkling and other distortion while hung upon the hangers. These shoulder guards usually are supplied to dry cleaning establishments separate from the garment hangers and must be assembled with the hangers, most often by personnel on the premises.

In an effort to reduce the complexity of assembling a shoulder guard with a garment hanger in the field, while at the same time providing exemplary protection for the garment to be hung on the garment hanger, I devised and developed an improved shoulder guard, as disclosed in my earlier U.S. Pat. No. 4,988,022. The present invention provides an even greater improvement in simplicity of construction as well as in effectiveness of operation. As such, the present invention exhibits several objects and advantages, some of which may be summarized as follows: Enables complete assembly and folding of a shoulder guard in the factory for shipment and storage in a compact collapsed condition and ready unfolding into an erected condition in the field for use in connection with a garment hanger, without the necessity for any supplemental fastening or assembly operations; provides an improved support configuration in a readily erected, fully assembled shoulder guard for placement upon a garment hanger in the field; precludes wrinkling, dimpling or other distortion or permanent damage in adjacent garments hung on adjacent hangers, by eliminating direct contact between the shoulder guard and an adjacent garment; enables economical manufacture in large quantities of uniform high quality and exemplary performance.

The above objects and advantages, as well as further objects and advantages, are attained by the present invention which may be described briefly as a shoulder guard for placement on a garment hanger so as to lie between the garment hanger and a garment to be hung on the garment hanger, the shoulder guard being capable of transportation and storage in an essentially flat collapsed condition and selective opening to an erected condition for placement on the garment hanger, without requiring a supplemental fastening operation, the shoulder guard comprising: a sheet of foldable material having a plan configuration including a front, a rear, opposite ends and a generally central transverse axis extending along a generally central area of the sheet, between the front and the rear of the sheet, intermediate the opposite ends; the sheet including first and second legs, each leg extending outwardly from a proximal end adjacent the transverse axis to a distal end adjacent a corresponding one of the opposite ends of the sheet, the first and second legs extending at an obtuse angle to one another, each leg having a front edge extending along the front of the sheet, between the respective proximal and distal ends, and a rear edge extending along the rear of the sheet, between the respective proximal and distal ends; an aperture in the sheet, the aperture being located on the transverse axis between the front and the rear of the sheet; a first fold line in the sheet, the first fold line extending from the aperture to the front edge of the first leg and making a first angle with the transverse axis; a second fold line in the sheet, the second fold line extending from the aperture to the rear edge of the second leg and making a second angle with the transverse axis; a slot extending between the aperture and the rear of the sheet, the slot making a third angle with the transverse axis and delineating a proximal portion of the first leg and a transverse edge on the first leg along the proximal portion, and a proximal flap on the second leg, between the slot and the second fold line; the first, second and third angles being such that upon folding the sheet along the first fold line the transverse edge of the proximal portion of the first leg is juxtaposed with the second fold line and the proximal portion of the first leg overlaps the proximal flap of the second leg, and the first and second legs extend at an acute angle to one another in the collapsed condition of the shoulder guard; and securing means for permanently securing together the overlapped proximal portion of the first leg and the proximal flap of the second leg such that upon opening the shoulder guard to the erected condition the first and second legs will extend at an obtuse angle to one another and the central area will be cupped, with the front of the sheet spaced transversely from the rear of the sheet.

The invention will be understood more fully, while still further objects and advantages will become apparent, in the following detailed description of a preferred embodiment of the invention illustrated in the accompanying drawing, in which.

Figure 1:
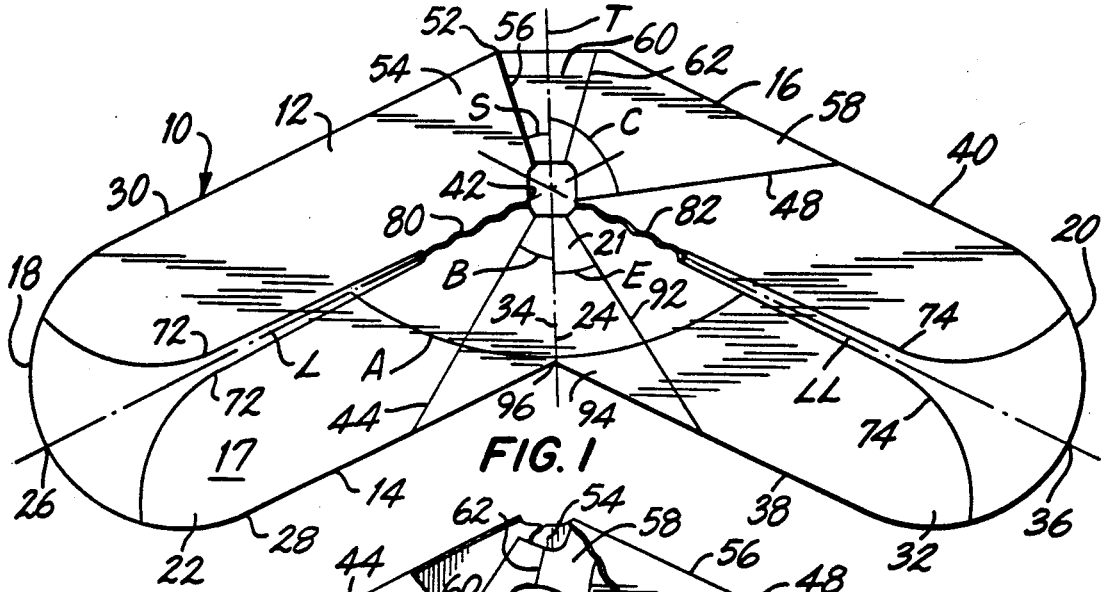
FIG. 1 is a top plan view of a blank from which the shoulder guard of the present invention is constructed.

Referring now to the drawing, and especially to FIG. 1 thereof, a blank 10 is constructed of a sheet 12 of card stock and is seen to have a plan configuration which includes a front 14, a rear 16, an upper surface 17, a lower surface 19 (see FIGS. 2 and 3) and opposite ends 18 and 20. A transverse axis T extends across the sheet 12, between the front 14 and the rear 16 and intermediate the ends 18 and 20, and is located essentially centrally with respect to the ends 18 and 20 within a central area 21 of the sheet 12. Sheet 12 includes a first leg 22 which extends from a proximal end 24, adjacent transverse axis T, outwardly to a distal end 26, at the end 18 of the sheet 12 and includes a front edge 28 extending along the front 14 of the sheet 12 and a rear edge 30 extending along the rear 16 of the sheet 12. A second leg 32 extends from a proximal end 34, adjacent the transverse axis T, outwardly to a distal end 36 at the end 20 of the sheet 12 and includes a front edge 38 extending along the front 14 of the sheet 12 and a rear edge 40 extending along the rear 16 of the sheet 12. The first leg 22 and the second leg 32 make an obtuse angle to one another, as illustrated by the obtuse angle A between the longitudinal axis L of the first leg 22 and the longitudinal axis LL of the second leg 32.

An aperture 42 in the sheet 12 is located on the transverse axis T intermediate the front 14 and the rear 16 of the sheet 12. A first fold line 44 extends from the aperture 42 to the front edge 28 of the first leg 22 and makes an angle B with the transverse axis T. A second fold line 48 extends from the aperture 42 to the rear edge 40 of the second leg 32 and makes an angle C with the transverse axis T. A slot 52 extends from the aperture 42 to the rear 16 of the sheet 12 and makes an angle S with the transverse axis T. Slot 52 delineates a proximal portion 54 of the first leg 22 and a transverse edge 56 on the first leg 22 along the proximal portion 54. Slot 52 also delineates a proximal flap 58 on the second leg 32, which proximal flap 58 extends between the slot 52 and the second fold line 48. A supplemental flap 60 is located on the second leg 32, between the slot 52 and the proximal flap 58, and a score line 62 divides the supplemental flap 60 from the proximal flap 58, for purposes which will be described below.

Figure 2:
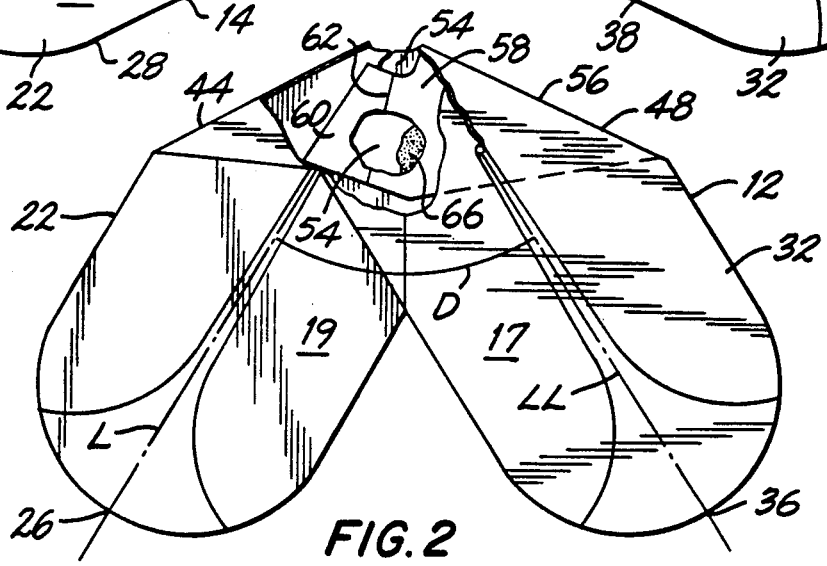
FIG. 2 is a top plan view of the shoulder guard folded into a collapsed condition.
Figure 3:
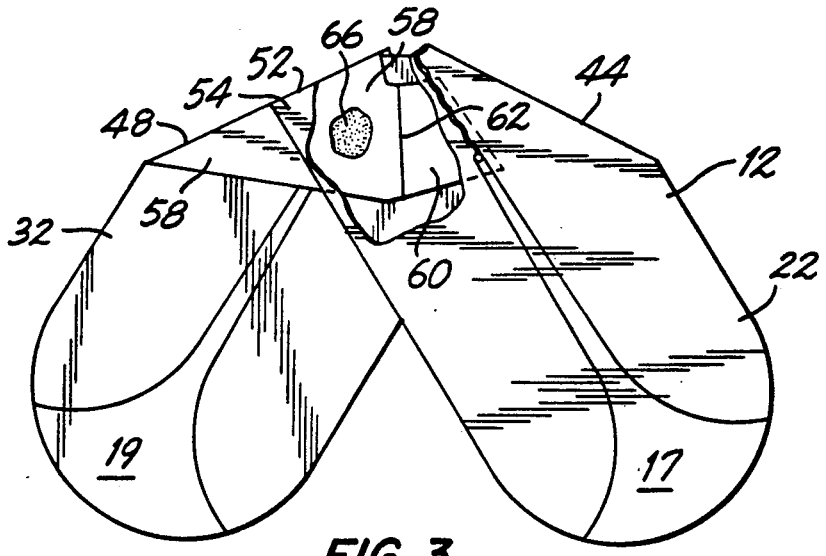
FIG. 3 is a bottom plan view of the shoulder guard folded into the collapsed condition.

The angles B, C and S are such that upon folding the sheet 12 along the first fold line 44, as seen in FIGS. 2 and 3, the transverse edge 56 of the proximal portion 54 of the first leg 22 is juxtaposed with the second fold line 48 and the proximal portion 54 of the first leg 22 overlaps the proximal flap 58 of the second leg 32, thus folding the sheet 12 into a flat collapsed condition in which the first leg 22 and the second leg 32 extend at an angle D to one another and establish a relatively deep generally V-shaped configuration. Securing means in the form of an adhesive 66 is placed between the overlapped proximal portion 54 of the first leg 22 and the proximal flap 58 of the second leg 32 to secure the lower surface 19 of the proximal portion 54 and the upper surface 17 of the proximal flap 58 together permanently. In the described collapsed condition illustrated in FIGS. 2 and 3, the sheet 12 is essentially flat and lies in the plane of the paper. In that collapsed condition, the sheet 12 may be stacked conveniently in a compact fashion for transportation and storage.

Figure 4:
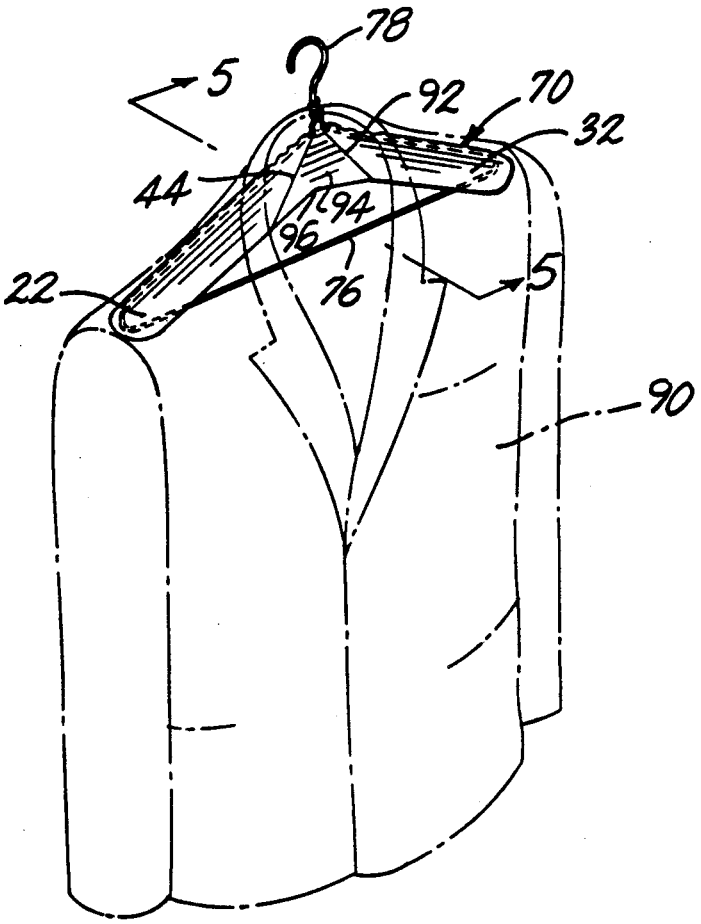
FIG. 4 is a pictorial view of the shoulder guard erected and placed upon a garment hanger, with a garment illustrated in phantom.
Figure 5:
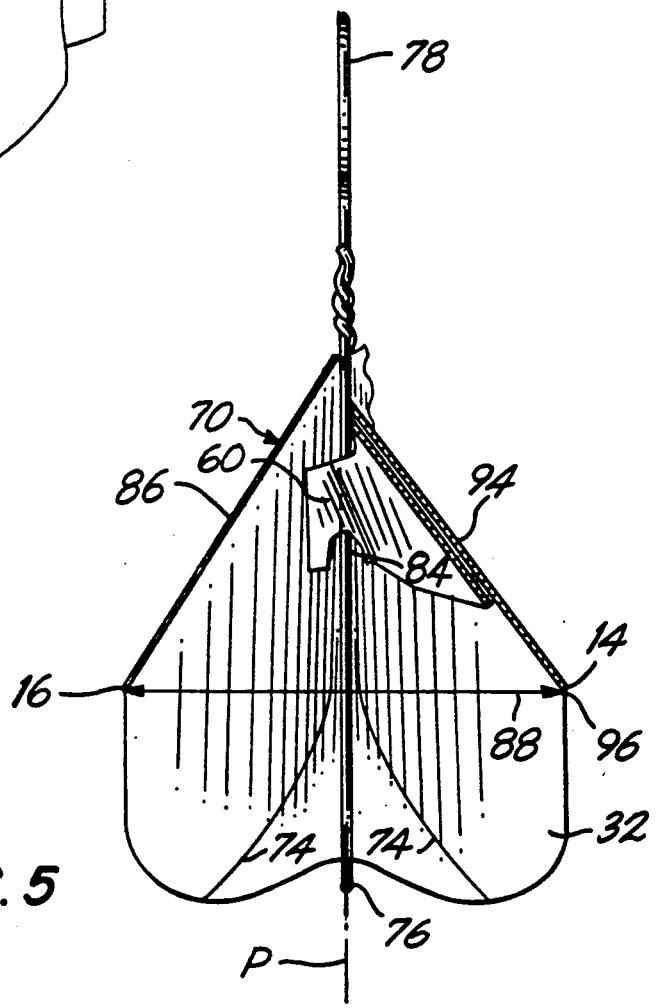
FIG. 5 is an enlarged cross-sectional view taken along line 5—5 of FIG. 4.

When it is desired to put the shoulder guard to use, the sheet 12 is unfolded into an erected condition, as illustrated at 70 in FIGS. 4 and 5. The legs 22 and 32 are moved out of the flat collapsed condition and are spread apart such that the longitudinal axes L and LL are brought into alignment within the same vertical plane P and the legs 22 and 32 extend in a relatively shallow generally V-shaped configuration. Each of the legs 22 and 32 will then be bent about respective score lines 72 and 74 in the legs 22 and 32 to establish a shoulder-like shape along the legs 22 and 32. The shoulder guard 70 is slipped over a garment hanger 76 with the hook 78 of the garment hanger 76 passing through the aperture 42 and through undulant slits 80 and 82 provided contiguous with aperture 42 to ease insertion of the hook 78 through the sheet 12. As an added measure, the supplemental flap 60 on the second leg 32 is passed beneath a corresponding portion 84 of the garment hanger 76 to assist in the proper location and securement of the shoulder guard 70 on the garment hanger 76.

Upon spreading apart the legs 22 and 32, as described above, the central area 21 of sheet 12 will become cupped to form a contoured central portion 86 of the shoulder guard 70, as best seen in FIG. 5, with the front 14 and the rear 16 of the sheet 12 spaced transversely from one another, as illustrated by the spacing 88. The weight of the garment 90 to be hung on the garment hanger 76 will assure that the central portion 86 remains cupped and provides a support contoured to preclude wrinkling or other distortion of the garment 90. A third fold line 92 extends from the aperture 42 to the front edge 38 of the second leg 32 and makes an angle E with transverse axis T, to delineate a frontal sector 94 established between the first fold line 44 and the third fold line 92, which frontal sector 94 assures that the contour is appropriate for the garment 90; that is, since the garment 90 is open at the front, the outward extent of the cupped central portion 86 is relieved somewhat by the flatter frontal sector 94 so that the garment 90 is not distorted by being spread open too far by the cupped central portion 86, beyond the amount necessary to support the garment 90 in a non-wrinkled, undistorted configuration. Moreover, the frontal sector 94, together with the recessed V-shaped configuration at 96, assures that the shoulder guard 70 is precluded from protruding outwardly of garment 90 far enough to engage an adjacent garment on an adjacent hanger and causing wrinkling, dimpling or other distortion, or even permanent damage, in the adjacent garment.

In the preferred construction, the obtuse angle A between the first leg 22 and the second leg 32 in the blank 10, as illustrated in FIG. 1, is about one-hundred-thirty degrees. Upon folding the sheet 12, as seen in FIGS. 2 and 3, the angle D between the first leg 22 and the second leg 32 is an acute angle of about fifty-five degrees. The preferred angle B between the first fold line 44 and the transverse axis T is an acute angle of about twenty-seven and one-half degrees, and the preferred angle E between the third fold line 92 and the transverse axis T also is an acute angle of about twenty-seven and one-half degrees. The preferred angle C between the second fold line 48 and the transverse axis T is an obtuse angle of about one-hundred-ten degrees. The preferred angle S between the slot 52 and the transverse axis T is an acute angle of about twenty degrees.

It will be seen that the shoulder guard 70 of the present invention attains the several objects and advantages summarized above; namely: Enables complete assembly and folding of a shoulder guard in the factory for shipment and storage in a compact collapsed condition and ready unfolding into an erected condition in the field for use in connection with a garment hanger, without the necessity for any supplemental fastening or assembly operations; provides an improved support configuration in a readily erected, fully assembled shoulder guard for placement upon a garment hanger in the field; precludes wrinkling, dimpling or other distortion or permanent damage in adjacent garments hung on adjacent hangers, by eliminating direct contact between the shoulder guard and an adjacent garment; enables economical manufacture in large quantities of uniform high quality and exemplary performance.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

I claim:

1. A shoulder guard for placement on a garment hanger so as to lie between the garment hanger and a garment to be hung on the garment hanger, the shoulder guard being capable of transportation and storage in an essentially flat collapsed condition and selective opening to an erected condition for placement on the garment hanger, without requiring a supplemental fastening operation, the shoulder guard comprising:

a sheet of foldable material having a plan configuration including a front, a rear, opposite ends and a generally central transverse axis extending along a generally central area of the sheet, between the front and the rear of the sheet, intermediate the opposite ends;

the sheet including first and second legs, each leg extending outwardly from a proximal end adjacent the transverse axis to a distal end adjacent a corresponding one of the opposite ends of the sheet, the first and second legs extending at an obtuse angle to one another, each leg having a front edge extending along the front of the sheet, between the respective proximal and distal ends, and a rear edge extending along the rear of the sheet, between the respective proximal and distal ends;

an aperture in the sheet, the aperture being located on the transverse axis between the front and the rear of the sheet;

a first fold line in the sheet, the first fold line extending from the aperture to the front edge of the first leg and making a first angle with the transverse axis;

a second fold line in the sheet, the second fold line extending from the aperture to the rear edge of the second leg and making a second angle with the transverse axis;

a slot extending between the aperture and the rear of the sheet, the slot making a third angle with the transverse axis and delineating a proximal portion of the first leg and a transverse edge on the first leg along the proximal portion, and a proximal flap on the second leg, between the slot and the second fold line;

the first, second and third angles being such that upon folding the sheet along the first fold line the transverse edge of the proximal portion of the first leg is juxtaposed with the second fold line and the proximal portion of the first leg overlaps the proximal flap of the second leg, and the first and second legs extend at an acute angle to one another in the collapsed condition of the shoulder guard; and securing means for permanently securing together the overlapped proximal portion of the first leg and the proximal flap of the second leg such that upon opening the shoulder guard to the erected condition the first and second legs will extend at an obtuse angle to one another and the central area will be cupped, with the front of the sheet spaced transversely from the rear of the sheet.

2. The invention of claim 1 wherein the securing means comprises an adhesive securing together the proximal portion of the first leg and the proximal flap of the second leg.

3. The invention of claim 1 wherein the obtuse angle between the first and second legs is about one-hundred-thirty degrees.

4. The invention of claim 1 wherein the acute angle between the first and second legs, when the shoulder guard is in the collapsed condition, is about fifty-five degrees.

5. The invention of claim 1 wherein the first angle is an acute angle.

6. The invention of claim 1 wherein the first angle is about twenty-seven and one-half degrees.

7. The invention of claim 1 wherein the second angle is an obtuse angle.

8. The invention of claim 1 wherein the second angle is about one-hundred-ten degrees.

9. The invention of claim 1 wherein the third angle is an acute angle.

10. The invention of claim 1 wherein the third angle is about twenty degrees.

11. The invention of claim 1 including a third fold line extending from the aperture to the front edge of the second leg and making a fourth angle with the transverse axis, the first fold line and the third fold line delineating a frontal sector in the cupped central area of the sheet, which frontal sector establishes a corresponding contoured central portion in the shoulder guard to conform the shoulder guard more closely to the undistorted configuration of the garment to be hung on the garment hanger.

12. The invention of claim 11 wherein the first angle and the fourth angle each are acute angles.

13. The invention of claim 12 wherein the acute angles are about twenty-seven and one-half degrees.

14. The invention of claim 1 including a supplemental flap on the second leg between the slot and the proximal flap for reception of a portion of the garment hanger between the first leg and the supplemental flap.

* * * * *